US005531000A

United States Patent [19]

Biondo

[11] Patent Number: 5,531,000

[45] Date of Patent: Jul. 2, 1996

[54] SLIDE LOCKING EXTERNALLY REMOVABLE CASKET HARDWARE

[75] Inventor: John P. Biondo, Batesville, Ind.

[73] Assignee: Bateville Casket Company, Inc., Batesville, Ind.

[21] Appl. No.: 365,775

[22] Filed: Dec. 29, 1994

[51] Int. Cl.[6] ..... A61G 17/00

[52] U.S. Cl. ..... 27/27; 27/1; 16/114 R

[58] Field of Search ..... 27/1–2, 10, 27; 16/112, 114 R

[56] References Cited

U.S. PATENT DOCUMENTS

| | | | |
|---|---|---|---|
| 3,025,624 | 3/1962 | Harrell | 27/1 |
| 4,615,085 | 10/1986 | Hartman | 16/112 X |
| 5,008,990 | 4/1991 | Craft | 16/112 X |
| 5,144,727 | 9/1992 | Craft . | |
| 5,309,614 | 5/1994 | Mackirdy | 27/1 X |
| 5,323,511 | 6/1994 | Gray | 16/114 R |
| 5,335,402 | 8/1994 | Semon | 16/112 X |
| 5,377,395 | 1/1995 | Maier et al. . | |

*Primary Examiner*—Wynn E. Wood
*Assistant Examiner*—Beth A. Aubrey
*Attorney, Agent, or Firm*—Wood, Herron & Evans

[57] ABSTRACT

Casket hardware which may be quickly connected and disconnected without the use of tools and without necessitating access to the inside of the casket. The casket hardware essentially includes a mounting plate having an upper leg including a casket handle mount and a lower leg including a slot opening to one end of the plate. The slot is shaped to receive a wooden pin or dowel extending across a groove contained in an inner side of a base portion of the casket while a lower portion of the plate supports the casket base portion. The end of the lower leg is bent in a "U" shape to fit within the groove such that the slot may be aligned with the pin or dowel. The slot includes an open end portion for initially receiving the pin or dowel and a closed end portion in which the pin or dowel is restrained when the support plate is attached to the casket. An intermediate portion of the slot extends transversely between the open and closed end portions.

33 Claims, 3 Drawing Sheets

SLIDE LOCKING EXTERNALLY REMOVABLE CASKET HARDWARE

FIELD OF THE INVENTION

The present invention generally relates to a casket and, more specifically, to hardware mounted externally to a casket for aesthetic and functional purposes.

BACKGROUND OF THE INVENTION

Caskets made from wood generally have included metallic hardware for such purposes as providing mounting supports for a handlebar on each side of the casket. The hardware is usually ornamental to at least some extent to provide aesthetic qualities in addition to its functional considerations. In this latter regard, the hardware must provide enough strength and support to carry the full weight of the casket when the handlebars on both sides are lifted and the casket is transported or maneuvered.

Generally, casket hardware is fastened from inside the casket and, when the casket lid has been closed and locked after a funeral or memorial service, it cannot be opened to access the hardware fasteners on the inside. Thus, caskets have generally been cremated with the hardware still in place. However, metallic hardware causes certain problems during the cremation of wooden caskets. Moreover, as cremation is becoming increasingly popular, these problems have become an increasing concern in the industry.

Certain problems stem from the zinc which is often included as a major component in metallic casket hardware. Over time, zinc can damage and deteriorate the fire brick of the crematory. Also, melting and decomposition of the zinc during the cremation process can yield undesirable gases. Stamped steel casket hardware which cannot be removed prior to cremation also presents problems. During the cremation of caskets having this type of hardware, the steel generally does not melt during the cremation process but does sear to such incidental human remains as bone fragments. There are also the problems of removing such stamped steel hardware from the remains while it still may be hot and of disposing of such hardware. Needless to say, casket hardware which has been through the cremation process is not readily usable as casket hardware again.

One solution to the problems mentioned above is provided in commonly assigned U.S. Pat. No. 5,377,395. In that patent, a hardware assembly is disclosed which includes a bolt held in place by a plastic nut assembly contained inside the casket. A pin extends through the bolt and may be actuated by a tool from outside the casket to release the plastic nut assembly from the bolt. The plastic nut assembly falls to the bottom of the casket and is readily destroyed by the cremation process. All of the external hardware is then removable and may be readily used on another casket. Although this hardware is vastly improved over past hardware assemblies in many ways, it does have the drawback of generally necessitating the use of a tool to actuate the pin and release the plastic nut assembly.

Also, past casket hardware mounting methods have required mounting holes in the sides of the casket for receiving mounting bolts, etc. Thus, hardware is typically not removed for display purposes, as might sometimes be desirable, because of the unsightly mounting holes which would then be visible.

It would therefore be desirable to provide externally mounted casket hardware which is removable from the casket without opening the casket lid, without the use of tools and without requiring mounting holes through the casket.

SUMMARY OF THE INVENTION

It has therefore been one objective of the present invention to provide casket hardware which may be completely removed from the casket without opening the casket lid.

It has been another object of the invention to provide casket hardware which is quickly attached and removed without the use of tools.

It has been still another object of the invention to also eliminate the need for hardware mounting holes through the outside of the casket.

A further object has been to provide casket hardware which may be removed without leaving hardware pieces or components on or within the casket.

To these ends, the present invention provides a casket with casket hardware which may be quickly connected and disconnected without the use of tools and without necessitating access to the inside of the casket. More specifically, the casket hardware essentially includes a mounting plate which comprises upper and lower legs. The upper leg provides a handle mount and the lower leg provides a casket supporting surface and includes a slide locking element for engaging and disengaging a slide locking element fixed on the casket.

More specifically, the slide locking element on the mounting plate is preferably a slot opening to one end of the plate. The slot is shaped to receive the slide locking element of the casket which is preferably a wooden pin or dowel extending across a groove in a base portion of the casket. The bottom or lower leg of the support plate is angled to fit within the groove such that the slot, contained in the angled plate portion, may be aligned with the pin or dowel. The groove is preferably along an inner surface of a base molding piece of the casket and the angled portion of the lower leg is preferably a "U"-shaped bend at the end of the plate.

The slot includes an open end portion for initially receiving the pin or dowel and a closed end portion in which the pin or dowel is restrained when the support plate is attached to the casket. The portions of the slot having the open and closed ends are preferably separated by an intermediate slot portion which extends transversely therebetween. This intermediate slot portion provides a stop surface which restrains the support plate from being removed from the closed portion of the slot in the same direction in which it was inserted. Preferably, the plate is therefore moved in a first direction such that the dowel or pin is received in the slot. The plate is then moved in a second direction, transverse to the first direction, to move the dowel or pin through an intermediate portion of the slot. Finally, the plate is again moved in the first direction to the closed end of the slot where the plate is effectively locked in place until the connecting procedure is reversed to disconnect the plate from the casket.

Three alternative embodiments of the invention are specifically provided for herein, however, all three have common features. These common features include a mounting plate as described above with the upper and lower legs being connected generally in an "L" shape. The lower leg includes an upper, horizontal support surface which provides the main support point for the weight of the casket while the upper leg in each embodiment includes a casket handle mount. In the preferred embodiments, the bottom support leg is provided with two slots, as described above, for registering with two pins or dowels in the base molding of the casket. In a first embodiment, the upper leg simply includes a handle mount comprising a curved portion which receives a handlebar. In the second embodiment, the upper leg receives a pair of detachable mounts which, in turn, receive the handlebar. In the third embodiment, a pivoting handle is connected to the upper leg and is preferably also connected to a connecting bar. The connecting bar is connected to further pivoting handles along the side of a casket such that all handles will be lifted at once.

In all three embodiments, three support plates are preferably used on each side of a casket. Each may be connected separately or in unison with the others on the same side when they are each rigidly fastened at the proper lengthwise position along the handlebar or connecting bar. As the pins or dowels in the base of the casket are wooden, it will be appreciated that when the mounting plates and handlebars are removed, no metallic hardware components remain in or on the casket. As will further be appreciated, quick connection and disconnection of the mounting plates as well as sturdy support for the casket is provided by the hardware of the present invention without necessitating tools for installation or removal.

Further objects and advantages of the invention will become even more readily apparent from the following detailed description taken in conjunction with the accompanying drawings.

DETAILED DESCRIPTION OF THE PREFERRED EMBODIMENTS

Figure 1:
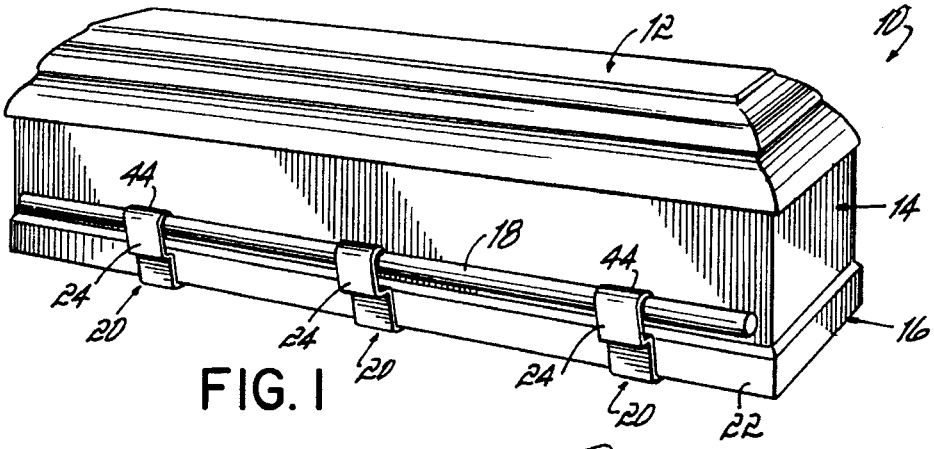
FIG. 1 is a perspective view of a casket having externally mounted hardware including a mounting plate made in accordance with a first embodiment of the invention.

Referring first to FIG. 1, a casket 10 is shown and generally includes a lid 12, an intermediate portion 14 and a base portion 16 which together form an enclosure. Handlebars 18 are supported on both sides of casket 10 by hardware 20 constructed in accordance with a first embodiment of the invention. Although only one side of casket 10 is illustrated, it will be appreciated that an identical handlebar 18 is similarly attached to the opposite side of casket 10.

Figure 2:
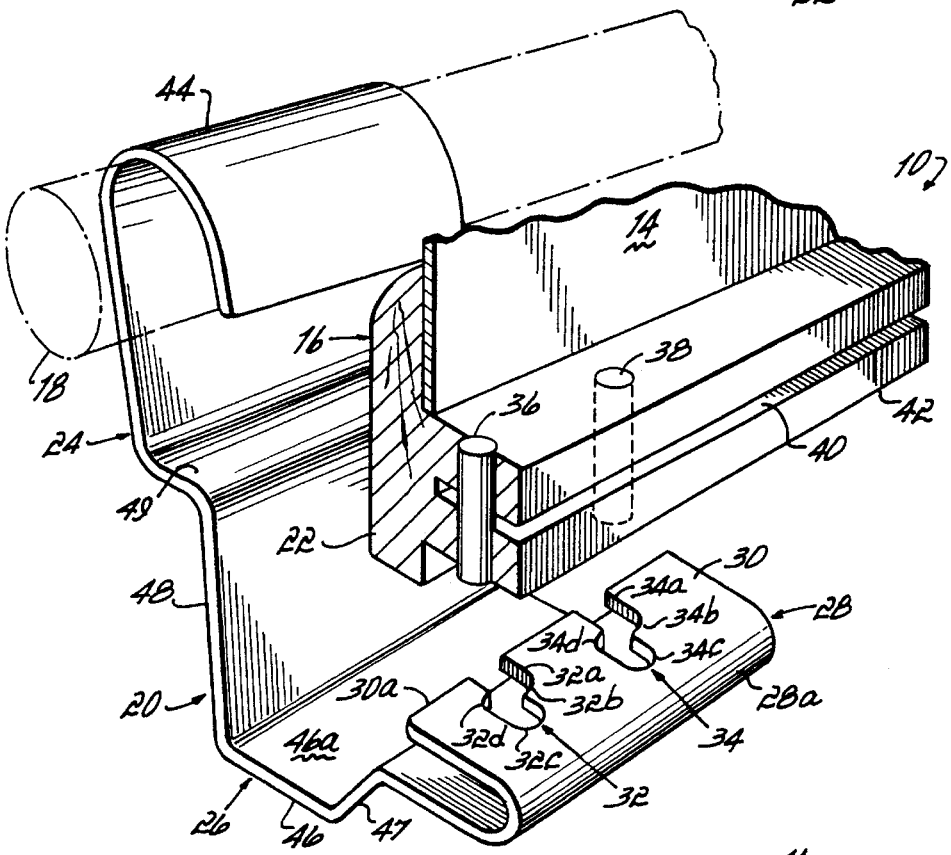
FIG. 2 is an enlarged perspective view of the mounting plate shown in FIG. 1 as well as the pins or dowels in the base molding of the casket.

The unique mounting of hardware 20 to base portion 16 and, more specifically, to base molding 22 is best understood from FIG. 2. In this first embodiment hardware 20 is preferably formed as a stamped steel mounting plate generally "L"-shaped and including an upper leg 24 for holding handlebar 18 and a lower, casket supporting leg 26. Casket supporting leg 26 includes a "U"-shaped portion 28 having a connecting plate 30 which extends from a bend 28*a* in "U"-shaped portion 28 generally toward upper leg 24 and defines the end of lower leg 26. Connecting plate 30 preferably includes two connecting slots 32, 34 extending inwardly from an edge 30*a* of plate 30. Each slot is shaped identically with respective open end portions 32*a*, 34*a*, transverse intermediate portions 32*b*, 34*b*, and closed end portions 32*c*, 34*c*.

As further shown in FIG. 2, base molding 22 of casket 10 includes a pair of wooden pins or dowels 36, 38 and a groove 40 extending into an inner part 42 of base molding 22. Dowels 36, 38 are driven into portion 42 of base molding 22 such that they extend across groove 40. Depending on the tightness of their fit when driven into the necessary holes, dowels 36, 38 may also be glued in place. Dowels 36, 38 are spaced from one another the same distance as slots 32, 34 in connecting plate 30, while groove 40 is of height just sufficient for accommodating the thickness of plate 30 in a sliding manner. Dowels 36, 38 each have a diameter which allows them to be received in slots 32, 34 with a sliding frictional fit.

Figure 2A:
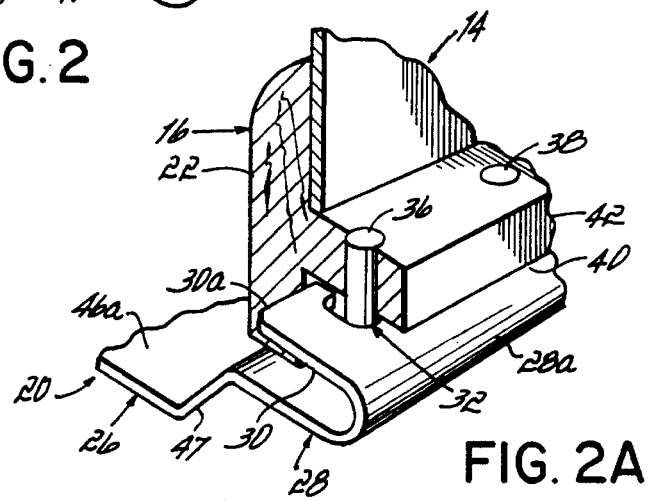
FIG. 2A is perspective view illustrating a portion of the components shown in FIG. 2 but showing a full engagement position of a pin or dowel within a slot in the mounting plate.

Referring now to FIGS. 2 and 2A, it will readily be understood that the attachment of mounting plate 22 to casket 10 is made by simply inserting connecting plate 30 into groove 40 while aligning the respective slots 32, 34 with dowels 36, 38. This alignment should be rather easily accomplished by sliding edge 30*a* back and forth against dowels 36, 38 until dowels 36, 38 align with and enter open end portions 32*a*, 34*a* of slots 32, 34. Plate 20 is then pulled outwardly with respect to casket 10 until dowels 36, 38 reach the intermediate, transverse portion 32*b*, 34*b* of the respective slots 32, 34 whereupon plate 20 is moved lengthwise along groove 40 a short distance until reaching closed slot portions 32*c*, 34*c*. Plate 20 is finally pulled in an outward direction with respect to casket 10 once again until each dowel 36, 38 rests within the closed end portion 32*c*, 34*c* of the respective slots 32, 34 (FIG. 2A). At this position, surfaces 32*d*, 34*d* act as stop surfaces to prevent the withdrawal of connecting plate 30 in a straight, outward direction from groove 40. This effectively locks plate 20 to casket 10 and prevents unintended disconnections of plates 20 from base molding 22. For the most effective locking, transverse slot portions 32*b*, 34*b* and their respective stop surfaces 32*d*, 34*d* are preferably disposed essentially perpendicularly to closed end slot portions 32*c*, 34*c*. To make the connecting and disconnecting movement of plate 20 easier, open slot portions 32*a*, 34*a* extend parallel to closed slot portions 32*c*, 34*c*. With the above description of the connecting motions, the disconnection of plate 20 will be readily understood to occur with exactly the opposite motions.

Figure 3:
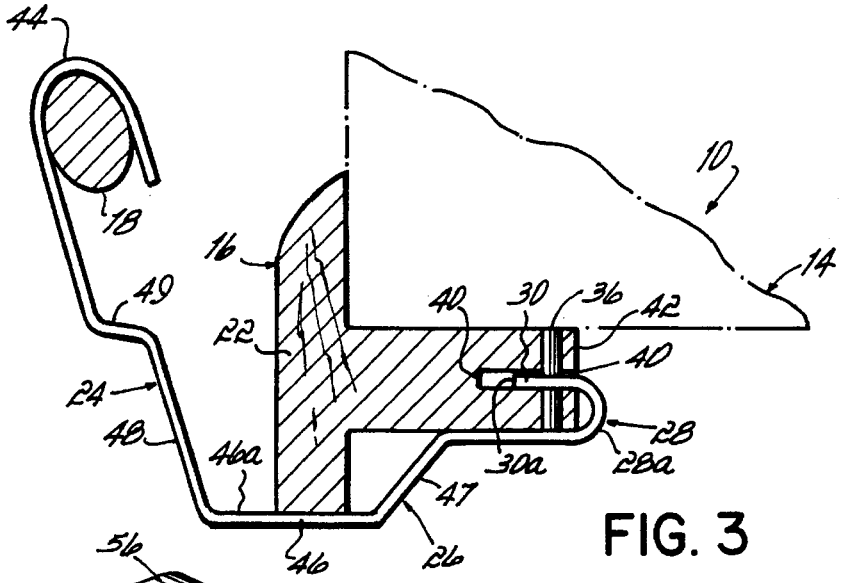
FIG. 3 is a cross-sectional view of the mounting plate, handlebar and casket of FIG. 1 with the mounting plate fully connected in a supporting position at the base of the casket.

FIG. 3 illustrates a mounting plate 20 which has been fully connected to casket 10 and locked in place in the manner described above. As also best shown in FIG. 3, upper leg 24 of this first embodiment simply includes a "U"-shaped end 44 for receiving the handlebar 18. Moreover, when plate 20 has been connected and locked in the position shown, a horizontal plate portion 46 of casket supporting leg 26 supports casket 10 by supporting its base 16 and, more specifically, by supporting base molding 22 on an upper surface 46*a*. As further shown in FIG. 3, upwardly angled plate portions 47, 48 extend from horizontal plate portion 46. Plate portion 47 connects horizontal plate portion 46 to "U"-shaped connecting plate portion 28, while plate portion 48 connects to "U"-shaped handlebar connecting portion 44 by way of an additional bend portion 49 in leg 24. Bend portion 49 may be used, for example, to keep handlebar 18 from falling out of "U"-shaped portion 44. Of course other means of securing handlebar 18 within "U"-shaped portion 44 or to upper leg 24 in general may be substituted, or the handlebar may simply be inserted only when casket 10 is to be lifted or moved. When handlebar 18 is lifted, the main direct support area for the weight of casket 10 is horizontal plate portion 46 which is approximately midway between the opposite ends of plate 20 as shown in FIG. 3.

Figure 4:
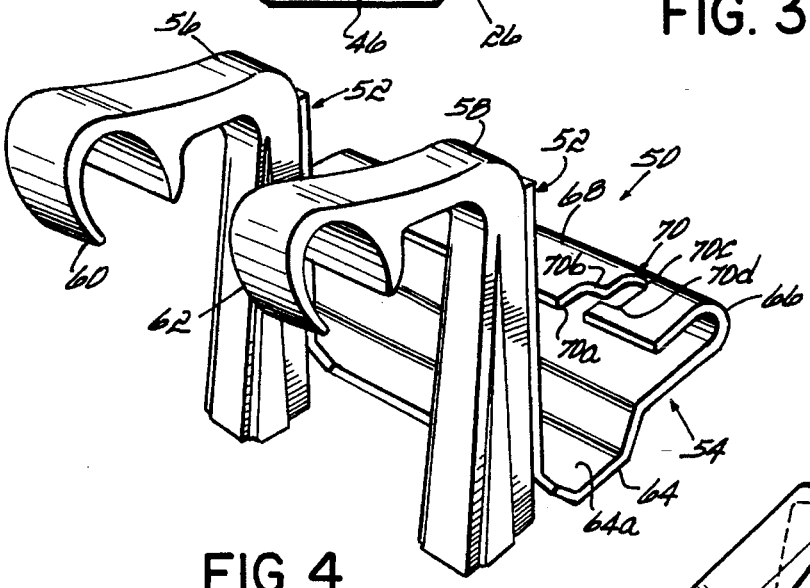
FIG. 4 is a perspective view of casket hardware constructed according to a second embodiment of the invention.

FIG. 4 illustrates casket hardware 50 constructed in accordance with a second embodiment of the invention. Like the first embodiment, hardware 50 is preferably a stamped steel plate generally having an overall "L"-shape. In this embodiment, plate 50 includes a pair of upper legs 52 and a lower casket supporting leg 54. Casket supporting leg 54 is essentially identical to casket supporting leg 26 of the first embodiment. Upper legs 52 again mount a handlebar (not shown), but unlike the first embodiment, upper legs 52 accomplish this function indirectly by receiving a pair of handlebar mounts 56, 58. Handlebar mounts 56, 58 essentially provide an additional ornamental effect and may be formed from a suitable high strength plastic or die cast from a metal, and in either case are securely fastened to legs 52 by fasteners such as screws (not shown). Of course, handlebar mounts 56, 58 also perform the necessary function of holding a handlebar (not shown) to mounting plate 50 by providing outer handlebar grasping portions 60, 62 which may be designed to receive a standard 1" diameter handlebar, for example, with a tight grip.

Like the first embodiment, casket supporting leg 54 of plate 50 includes a casket support plate 64 having an upper surface 64*a* on which a base surface of a casket rests when plate 50 is connected in a manner identical to plate 20 as shown in FIG. 3. For enabling this connection, plate 50 further includes a "U"-shaped connecting portion 66 having a connecting plate 68. Just as with the first embodiment, plate 68 includes a pair of identical slots, although only one slot 70 is shown in FIG. 4. Slot 70 includes an open end portion 70*a*, a transverse intermediate portion 70*b* and a closed end portion 70*c*. The transverse intermediate portion 70*b* includes a stop surface 70*d*. The second slot (not shown) is identically shaped. It will therefore be appreciated that mounting plate 50 and its attached handlebar holding elements 56, 58 may be connected and locked and then unlocked and disconnected in an identical manner to plate 20 shown in FIGS. 1–3 as described above.

Figure 5:
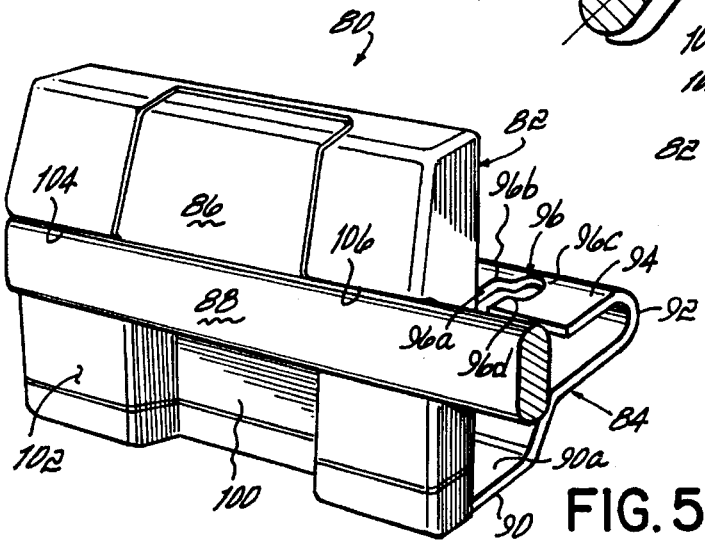
FIG. 5 is a perspective view of casket hardware constructed according to a third embodiment of the invention.
Figure 6:
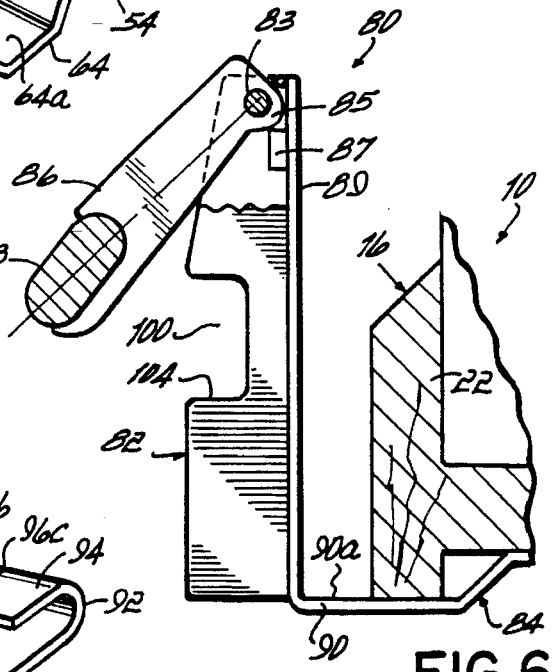
FIG. 6 is a side elevational view of the embodiment illustrated in FIG. 6 partially fragmented and showing the pivoting motion of a handle portion thereof; and, FIG. 7 is a fragmented perspective view of a casket fitted with the hardware of FIGS. 5 and 6.
Figure 7:
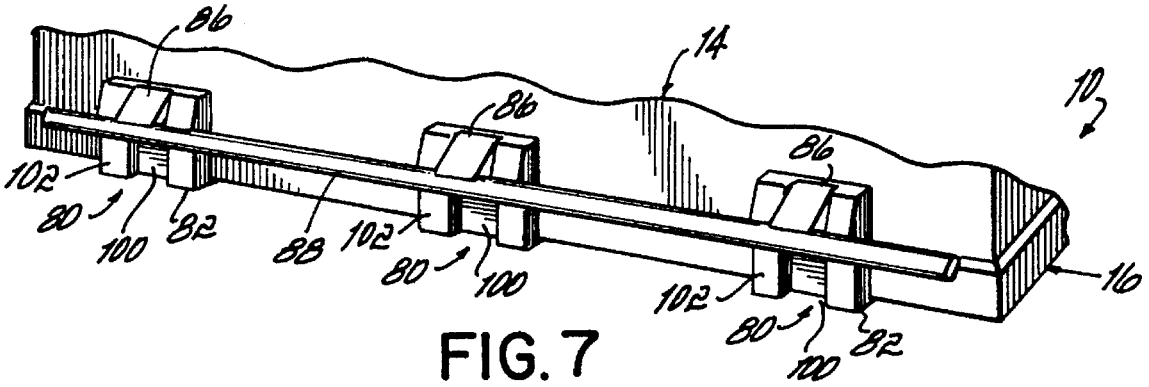

FIGS. 5–7 illustrate casket hardware 80 constructed in accordance with a third embodiment of the invention. Like the first and second embodiments, hardware 80 preferably includes a stamped steel plate generally having an overall "L"-shape. In this embodiment, hardware 80 again generally includes an upper leg 82 and a lower casket supporting leg 84. Casket supporting leg 84 is essentially identical to the respective casket supporting legs 26 and 54 of the first and second embodiments. In this third embodiment, upper leg 82 includes a pivoting handle 86 which is best shown in FIG. 6. Handle 86 is pivotally mounted to upper leg 82 by a pin 83 and is stopped at the raised position shown in FIG. 6 by projection or stop portion 85 of handle 86 contacting a stop member 87 rigidly fixed to an upper plate portion 89 of upper leg 82. A connecting bar 88 is rigidly connected to handle 86 and is also rigidly connected to the handles of further mounting plate assemblies 80 along the side of casket 10 as shown in FIG. 7.

Like the first and second embodiments, casket supporting leg 84 of mounting plate assembly 80 includes a casket support plate 90 having an upper surface 90*a* on which a base surface of a casket rests when plate assembly 80 is connected in a manner identical to plate 20 as shown in FIG. 3. For enabling this connection, plate 80 further includes a "U"-shaped connecting portion 92 having a connecting plate 94. Just as with the first embodiment, plate 94 includes a pair of identical slots, although only one slot 96 is shown in FIG. 5. Slot 96 includes an open end portion 96*a*, a transverse intermediate portion 96*b* and a closed end portion 96*c*. The transverse intermediate portion 96*b* includes a stop surface 96*d*. The second slot (not shown) is identically shaped. It will therefore be appreciated that mounting plate assembly 80 and its attached handle 86 and connecting bar 88 may be connected and locked and then unlocked and disconnected in an identical manner to plate 20 shown in FIGS. 1–3 and described above. As three such assemblies 80 will be connected to a single connecting bar 88 as shown in FIG. 7, all three plate assemblies 80 may be connected to a casket in a simultaneous manner.

After plate assemblies 82 and their common connecting bar 88 have been attached to both sides of casket 10 in the manner shown in FIG. 7, each handle 86 is lifted by a pallbearer, for example, by inserting a hand into a recess 100 of upper leg 82. In the example shown, recess 100 may be provided in a strong but decorative outer facade portion 102 of upper leg 82 which is rigidly secured to the upper steel plate portion 89 as by a plurality of screw fasteners (not shown). Facade portion may be formed, for example, from a high strength plastic material or a metal. Handle 86 is then pulled upwardly to the position shown in FIG. 6. This also lifts connecting bar 88 out of a pair of recesses 104, 106 which communicate with recess 100. At this position, stop surfaces 85 and 87 contact one another to stop any further upward movement of handle 86. Casket 10 may then be lifted and, as with the first two embodiments, the weight of the casket is mainly borne by lower horizontal plate portion 64.

While preferred embodiments of the present invention have been shown and described in detail, many departures from these details may be made without departing from the spirit and scope of the inventive concepts disclosed herein. Therefore, Applicant's intent is not to be bound by to such details, but only by the scope of the appended claims.

What is claimed is:

1. Externally removable casket hardware for mounting to a casket comprising a mounting plate having a first leg and a second leg connected by a connecting portion, said first leg having at least one slide locking element for engaging and disengaging a mating element of a casket with a sliding movement, said second leg including a casket handle mount and wherein said slide locking element is disengageable in a sliding motion without accessing an interior of said casket.

2. The casket hardware of claim 1 wherein said slide locking element comprises at least one slot formed in said plate.

3. The casket hardware of claim 2 wherein said slot includes an open end portion, a closed end portion and an intermediate portion extending transversely between said open and closed end portions.

4. The casket hardware of claim 3 wherein said slot is located in an end portion of said first leg.

5. The casket hardware of claim 4 wherein said end portion of said first leg is generally "U"-shaped.

6. The casket hardware of claim 5 further comprising two of said slots in said generally "U"-shaped end portion of said first leg.

7. The casket hardware of claim 3 further comprising two of said slots in said first leg.

8. The casket hardware of claim 1 wherein said first leg includes a horizontal plate portion for supporting a base portion of said casket.

9. The casket hardware of claim 1 wherein said handle mount comprises a handlebar support.

10. The casket hardware of claim 9 wherein said handlebar support is a generally "U"-shaped bend portion of said second leg.

11. The casket hardware of claim 9 wherein said second leg includes a pair of handlebar supports rigidly connected thereto.

12. The casket hardware of claim 1 wherein said handle mount further comprises a handle pivotally connected to said second leg.

13. The casket hardware of claim 1 wherein said mounting plate is generally "L"-shaped with said first and second legs being connected together at an angle.

14. An externally removable mounting plate for attaching carrying a structure to a casket, the mounting plate including upper and lower plate portions connected by a bend formed therebetween, said lower plate portion having an upper surface for supporting a downwardly facing surface of said casket and an end portion including a slide locking element for engaging and disengaging a mating element on said casket, said upper plate portion including a casket handle mount and wherein said slide locking element is disengageable in a sliding motion without accessing an interior of the casket.

15. The mounting plate of claim 14 wherein said slide locking element is a slot in said lower plate portion.

16. The mounting plate of claim 15 wherein said slot includes an open end portion, a closed end portion and an intermediate portion extending transversely between said open and closed end portions.

17. The mounting plate of claim 16 further comprising two of said slots in said lower plate portion.

18. The mounting plate of claim 15 further comprising two of said slots in said lower plate portion.

19. The mounting plate of claim 14 wherein said handle mount comprises a handlebar support.

20. The mounting plate of claim 14 wherein said handle mount includes a pair of handlebar supports rigidly connected to said upper plate portion.

21. The mounting plate of claim 14 wherein said handle mount further comprises a handle pivotally connected to said upper plate portion.

22. A casket comprising:

an enclosure, a slide locking element affixed to said enclosure, a mounting plate having a first leg and a second leg connected by a connecting portion, said first leg having a slide locking element engageable and disengageable with said slide locking element of said enclosure, said second leg including a casket handle mount and wherein said slide locking element is disengageable in a sliding motion without accessing an interior of said enclosure.

23. The casket of claim 22 wherein said casket includes a base portion having a groove, the slide locking element of said casket further comprises a pin rigidly affixed to said base and extending across said groove, and the slide locking element of said first leg further comprises a slot sized to receive said pin.

24. The casket of claim 23 wherein said pin is formed from wood.

25. The casket of claim 23 wherein said groove is along an inner side of said base portion and said first leg further comprises a plate portion bent toward said second leg and sized to fit within said groove.

26. The casket of claim 23 wherein said first leg further includes a plate portion contacting a lower surface of the base portion of said casket.

27. The casket of claim 23 wherein said first leg includes a pair of spaced apart slots and said base portion includes a mating pair of pins spaced apart the same distance as said slots.

28. The casket of claim 27 wherein said pins are formed from wood.

29. The casket of claim 22 wherein said handle mount comprises a handlebar support.

30. The casket of claim 22 wherein said handle mount includes a pair of handlebar supports.

31. The casket of claim 22 Wherein said handle mount further comprises a handle pivotally connected to said second leg.

32. The casket of claim 31 further comprising a plurality of said mounting plates mounted to said casket.

33. The casket of claim 32 further comprising a connecting bar rigidly secured to the handles of adjacent mounting plates secured along one side of said casket.

* * * * *

UNITED STATES PATENT AND TRADEMARK OFFICE

CERTIFICATE OF CORRECTION

PATENT NO. : 5,531,000
DATED : July 2, 1996
INVENTOR(S) : John P. Biondo

It is certified that error appears in the above-indentified patent and that said Letters Patent is hereby corrected as shown below:

Column 6, line 50, "a casket" should be -- the casket --.

Column 7, line 21, "carrying a structure" should be

-- a carrying structure --.

Column 8, line 39, "Wherein" should be -- wherein --.

Signed and Sealed this

Seventh Day of January, 1997

*Attest:*

Bruce Lehman

BRUCE LEHMAN

*Attesting Officer*

*Commissioner of Patents and Trademarks*